United States Patent [19]

Yoder

[11] Patent Number: 5,063,723

[45] Date of Patent: Nov. 12, 1991

[54] MASONRY INSPECTION BLOCK

[76] Inventor: Eli J. Yoder, 7500 Richardson Rd., Sarasota, Fla. 34240

[21] Appl. No.: 623,058

[22] Filed: Dec. 6, 1990

[51] Int. Cl.[5] ..... E04B 1/04

[52] U.S. Cl. ..... 52/606; 52/421; 52/561; 52/306; 52/607

[58] Field of Search ..... 52/306, 307, 308, 598, 52/599, 607, 606, 100, 421, 561, 98

[56] References Cited

U.S. PATENT DOCUMENTS

| | | | |
|---|---|---|---|
| D. 266,363 | 9/1982 | Santos . | |
| 1,065,762 | 6/1913 | Ainsworth et al. . | |
| 1,302,667 | 5/1919 | Jones . | |
| 2,272,061 | 2/1942 | Drake | 52/306 |
| 3,123,244 | 3/1964 | Amundson . | |
| 3,674,913 | 7/1972 | Yates . | |
| 4,729,540 | 3/1988 | Rozema | 249/192 |

OTHER PUBLICATIONS

Advertising Flyer, "Florida Rock Industries", Pre Cut Block, 5/90.

*Primary Examiner*—Richard E. Chilcot, Jr.
*Assistant Examiner*—Robert Canfield
*Attorney, Agent, or Firm*—Dowell & Dowell

[57] ABSTRACT

A concrete construction block having at least one or more hollow cores or open cells and wherein an opening is molded between one cell and the outer face of the block and which opening is defined by edges having opposing outermost flanges which function to retain an inspection window seated within the core therebetween.

6 Claims, 2 Drawing Sheets

MASONRY INSPECTION BLOCK

BACKGROUND OF THE INVENTION

1. Field of the Invention

This invention is generally directed to masonry building blocks and more specifically to hollow core concrete blocks which are designed to function as inspection blocks by having incorporated therewith premolded openings by way of which an inspection may be made of the interior of a core from the face of the blocks. The openings in the blocks of the present invention are designed to function to retain transparent inspection windows or plates which are mounted within the blocks and are seated against flanges created or defined by the side edges of the openings. The openings in the block are also designed so that the blocks may be placed either top side up or top side down in the construction of a wall.

2. History of the Related Art

In many localities it is necessary to reinforce masonry construction such as walls formed of concrete hollow core building blocks by incorporating therewith steel dowel rods which are connected through the hollow cores of the blocks to steel dowel rods extending from the building foundation in such a manner that the walls are united to the steel extending therethrough. Conventionally, in residential concrete block construction steel dowel rods must be provided at specified intervals such as every sixteen feet and at each corner of a structure. In commercial construction the distance between the steel reinforcing often is decreased and therefore reinforcing distances of eight feet or less in some localities is standard.

In order for building inspectors or engineers to ensure that concrete block walls have been properly reinforced and that proper connections are made between the steel reinforcing rods extending therethrough, it is necessary to provide an "inspection hole" in the concrete blocks which are laid adjacent the foundation. Failure to provide the proper placement, overlapping and tying of the steel within the concrete walls can lead to wall failure, especially in those localities wherein environmental conditions are conducive to high winds generated by hurricanes, tornadoes or earthquakes. By way of background, the steel dowel or reinforcing rods which are embedded and which extend vertically from the foundation are tied to steel dowel rods which extend upwardly through aligned cores or hollow cells of the building blocks so that each course of blocks is tied to the remaining courses throughout the height of the wall. Along the top course, horizontally oriented steel rods are tied to the vertical rods thereby connecting the overall wall structure both horizontally and vertically. To further stabilize the steel within the concrete blocks and to ensure that the steel is locked to the blocks, each vertically open column defined by the aligned cells or cores of the blocks through which such steel extends are filled with concrete, mortar or other cementitious material after the proper placement of the steel has been assured by a building inspector or engineer. Unfortunately, to enable a vertical open column to be filled with a concrete or mortar material it is necessary to close the opening which forms the "inspection hole" in the blocks which are adjacent to the foundation.

In order to close the openings in conventional concrete blocks it is generally necessary to place a board against the face of the block and across the opening therein which forms the "inspection hole" and thereafter bracing the board to ensure that it remains against the face of the block as the cementitious material is poured within the hollow column. Frequently however, due to the weight of the material within the hollow column, the boards which are placed across the openings will fail allowing concrete to emerge through the "inspection hole" opening. Such accidents create a great deal of work to not only clear the area of the spill but to thereafter reinforce the opening and again fill the column with concrete.

Conventional "inspection holes" are formed generally in two manners. Generally, a worker on the job site either uses a hammer to chip and remove a portion of the facing of a hollow core concrete block to establish an opening therein or a power saw is used to cut the opening in the face of the concrete block. The openings permit workers to tie the steel within the blocks and also allow inspectors to determine whether proper joints have been created between the steel extending from the foundation and the steel within a wall.

Conventional methods of forming inspection holes are not only time consuming and man power inefficient but such techniques are often hazardous to workers. Utilizing a saw to cut openings in concrete blocks results in the creation of dust which not only presents a problem for inhalation but also a problem with regard to safety and protection of worker's eyes. Further, utilizing either conventional technique, blocks are frequently cracked or shattered during the cutting or chipping process and therefore materials are wasted.

In order to overcome some of the foregoing problems, some block companies have proposed to provide precut openings in blocks. Such openings are generally U-shaped in configuration and thus do not recognize the need to provide a block with an inspection hole opening which may be utilized when laid upside down. It is often necessary for block masons to lay the U-shaped precut block upside down due to the running bond and/or specifications from the general contractor that all inspection hole openings be placed on the inside or outside of a particular wall or building. Therefore, the remaining part of the U-shaped opening has to be removed by saw cutting or chipping so that all block and mortar debris can be removed flush with the concrete floor prior to inspections. Further, simply providing precut openings in the face of hollow core concrete blocks does not provide a solution to the need to seal the openings in the concrete blocks when it becomes necessary to fill a vertical column of hollow cores through which steel dowel rods have been placed with concrete or mortar. Some prior art building block structures which have openings created in their sides are disclosed in United States design patent U.S. Pat. No. 266,363 to Santos, and United States utility patents U.S. Pat. No. 1,065,762 to Ainsworth et al., U.S. Pat. No. 1,302,667 to Jones, U.S. Pat. No. 3,015,408 to Campbell et al., U.S. Pat. No. 3,123,244 to Amundson and U.S. Pat. No. 3,674,913 to Yates.

SUMMARY OF THE INVENTION

This invention is directed to masonry inspection blocks of the type which are hollow core concrete blocks having one or more openings into a core or cell and wherein the inspection openings extend from the top to the bottom of the blocks. The openings are molded so that the edges thereof are bevelled outwardly from the inner wall of the core to the outer face of the blocks with a pair of opposing flanges being provided along the facial portion of each edge so as to thereby provide abutment surfaces against which a transparent or other type of insert may be seated after being positioned within the core and pulled toward the face of the block to thereby selectively close the opening to permit the filling of the block with a concrete, mortar or other cementitious material.

It is a primary object of the present invention to provide concrete building blocks of the hollow core type which may be utilized as inspection blocks by preforming openings therein with the preformed openings being defined by edge walls which will function as abutment surfaces for supporting an insert plate that will substantially fill the opening after the block has been placed.

It is yet another object of the present invention to provide concrete building blocks of the hollow core type wherein the blocks are adapted for use as inspection blocks by molding openings therein prior to the blocks being shipped to a work site to thereby overcome the short comings in conventional block construction which requires the hand forming of openings on site.

It is also an object of the present invention to facilitate the construction of walls utilizing hollow core concrete blocks by providing premolded inspection blocks having openings formed therein to facilitate the inspection of connections made within the core of the blocks during construction and wherein the openings may be quickly sealed utilizing plates or windows which may be inserted within the core of the blocks and thereafter seated across the opening therein under the influence of the material poured vertically through the core of the block.

It is yet another object of the present invention to provide premolded inspection blocks having openings therein which may be easily sealed after an inspection has been made and wherein the openings extend the full height of the blocks so that the blocks may be installed or laid either upright or upside down without effecting the use of the blocks as inspection blocks.

DESCRIPTION OF THE PREFERRED EMBODIMENT

Figure 4:
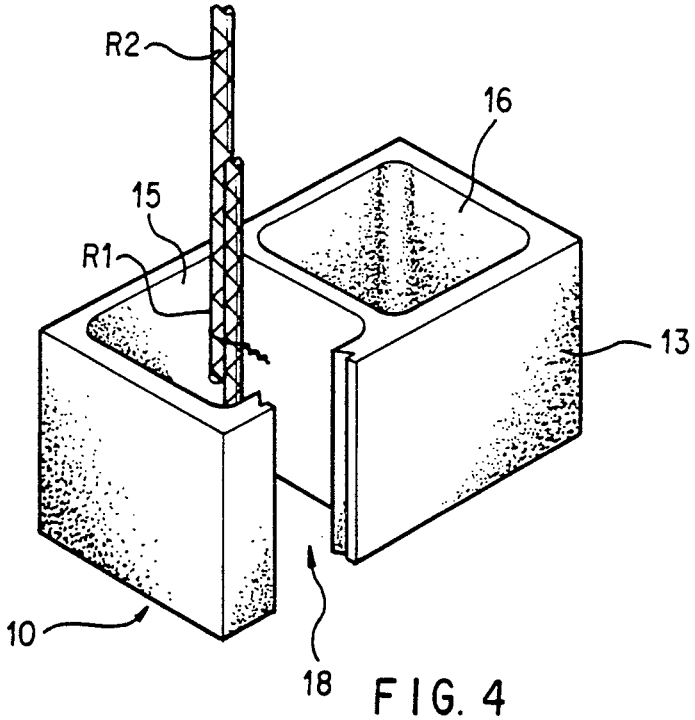
FIG. 4 is a perspective view illustrating the placement of steel dowel rods within a core of a concrete block such as shown in FIG. 1.

With continued reference to the drawings, the hollow core concrete blocks 10 of the present invention include upper edges 11, lower edges 12, a front face 13, and a rear face 14. Although the invention may be utilized with single, double, or even blocks having more than two cores, the present embodiment is shown as including two hollow cores 15 and 16 which are separated by a central web 17. With specific reference to FIG. 4 of the drawings, the inspection blocks of the present invention are designed for use for assuring the proper tying of steel dowel rods R1 and R2 which extend from the foundation and downwardly through a vertical course of blocks as has been previously discussed.

Figure 2:
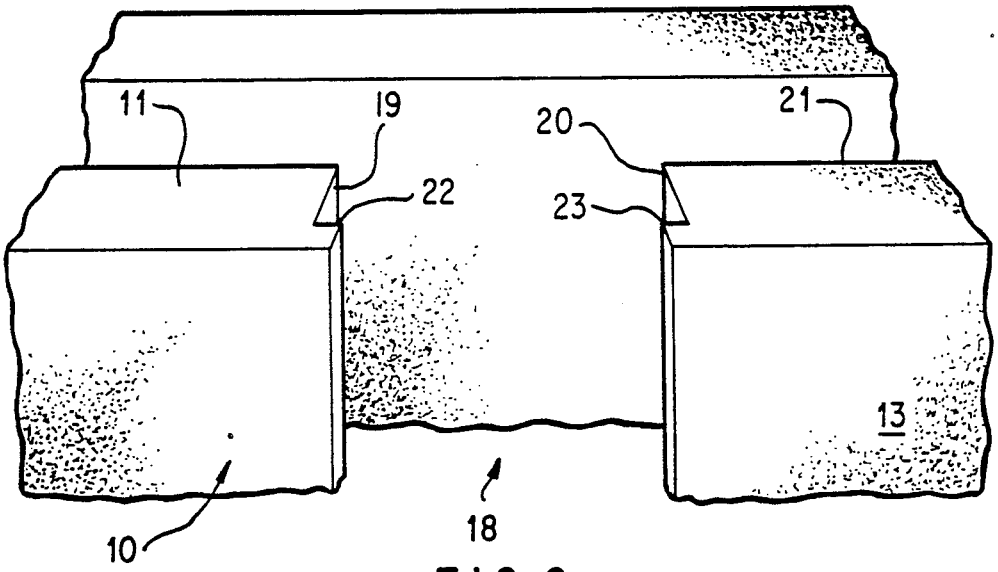
FIG. 2 is a partial enlarged view showing the opposing bevelled edges defining the opening into the concrete block of FIG. 1.
Figure 3:
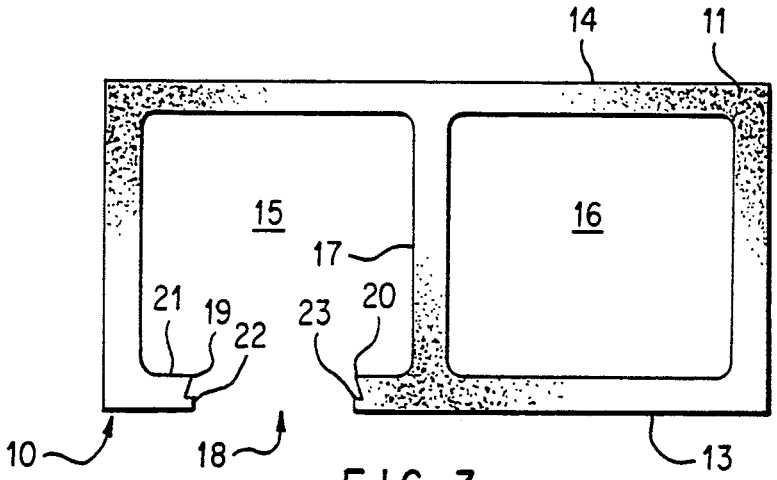
FIG. 3 is a top plan view of the construction block of FIG. 1.

In the present invention, an opening 18 is provided through the front face 13 of the block so as to communicate with open core or cell 15. The opening is defined by opposing edges 19 and 20. With reference to FIG. 2 of the drawings, each of the edges 19 and 20 are bevelled outwardly from the inner wall 21 of cell 15 toward the outer face 13 of the block but terminate in opposing flanges 22 and 23 which are oriented generally parallel with one another and with the front face 13 and rear wall 21 of the cell 15. In this manner, each of the opposing flanges 22 and 23 will form a seat for purposes of which will be illustrated in greater detail hereinafter.

As previously discussed, after an inspector has assured that the proper placement, overlapping and tying has been made between the steel dowel rods in a foundation and those extending vertically through a wall, the cores in which the steel has been placed must be filled with a concrete or mortar material so as to bond the steel more firmly with respect to the construction blocks.

To close the opening 18 in block 10 an inspection window or plate 25 may be inserted through the opening and into the core 15 and thereafter urged between the edges 19 and 20. The plate 25 includes opposing side walls 26 and 27 and upper and lower end walls 28 and 29. The overall size of the plate should be substantially equal to the size of the opening 18 in the block 10. The side walls 26 and 27 of the plate 25 are pulled into seated engagement against the inwardly extending flanges 22 and 23. In this position, once concrete or mortar is introduced into the core, the material will force the plate into tighter engagement with the flanges 22 and 23 thereby assuring that the plate will remain in position thus prevent any material from escaping through the opening 18 in the inspection block.

Figure 5:
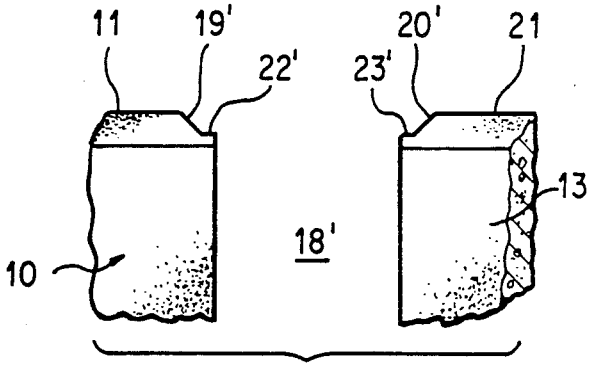
FIGS. 5 and 6 are partial views showing the side edges defining the opening into alternate embodiments of construction block of the present invention.

The tapered edges 19 and 20 of the opening 18 are designed to allow the window or plate 25 to be aligned relative to the outer portion of the opening 18 as it is pulled from the inner portion of the core 15 toward the outer face 13 of the block. In this respect, and as shown in FIG. 5, a second embodiment of the invention is shown wherein the opening 18' is defined by edges 19' and 20' which terminate in opposing flange portions 22' and 23'. In this embodiment, the edges are tapered inwardly from the inner wall 21 towards the outer or front face 13 of the block.

Figure 6:
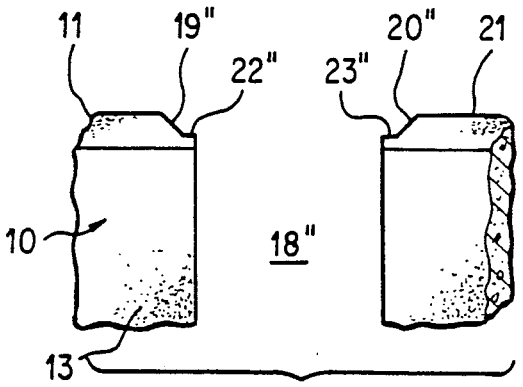

A further modification to the inspection blocks of the present invention is shown in FIG. 6 wherein the opening 18" is defined by side edges 19" and 20" which are generally parallel to one another and which terminate with opposing flanges 22" and 23".

In applicant's co-pending application filed concurrently herewith and entitled "Concrete Block Inspection Window Forms" the preferred form of transparent window for use with the blocks of the present invention is described in greater detail. Further, the co-pending application discloses methods of retaining the transparent window or plate within a block opening until such time as concrete, mortar or other cementitious material is cured within the core 15 of the block. It should be noted however that any type of closure member may be utilized with the present invention. In this respect, once the proper placement has been made with respect to the steel dowel rods as shown in FIG. 5 of the drawings, any type of closure or plate member which will substantially fill the opening 18 and which will seat against the opposing edges defining the opening in the concrete block and which will retain any material placed within the core may be utilized whether or not such plate is transparent, translucent or opaque. It should also be noted that the shape of the opening may be altered and yet remain within the teachings of the present invention. For instance, the opposing edges 19 and 20 in the preferred embodiment are shown as being generally parallel with respect to one another. In some instances, the opposing edges may be arcuately configured from top to bottom and yet an appropriate panel insert could be provided for seating against the outermost portions or flanges defined by such edges.

Figure 1:
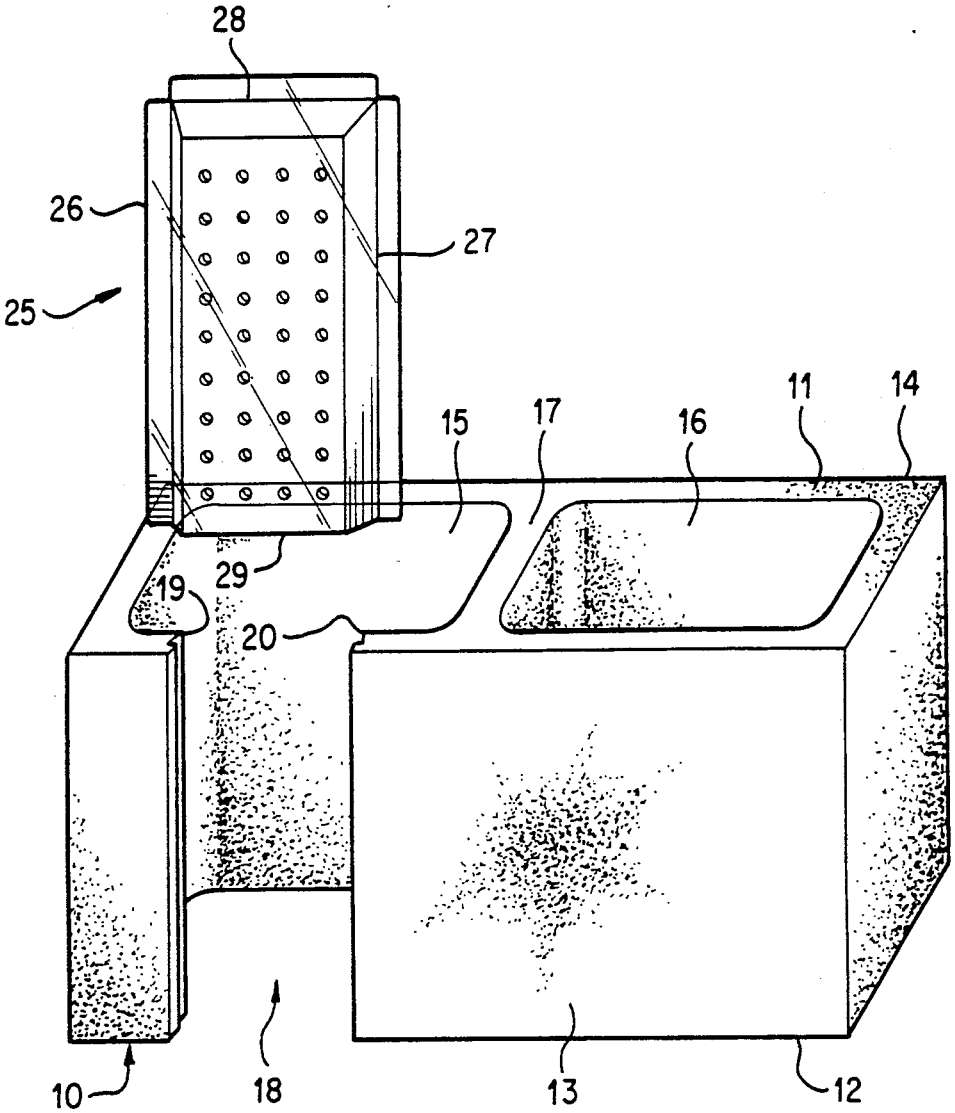
FIG. 1 is a top perspective illustrational view of a preferred embodiment for a construction block of the present invention showing the opening created through from the front face of the block and which opening is selectively sealed by placing a transparent closure member in seated engagement with the edges defining the opening in the block.

An important feature of the invention is that the opening 18 does extend from the top to the bottom edges of the block so that the block may be placed in a course either in the upright position as shown in drawing FIG. 1 or inverted so that the lower edge thereof defines the upper edge of the block upon installation. In this respect, the openings in the block may be selectively oriented to either the interior or exterior of a wall under construction.

I claim:

1. In a concrete construction block having at least one hollow core extending between an upper surface and lower surface thereof and which includes a facing surface which extends between the upper and lower surfaces, the improvement comprising an opening formed through said facing surface of the block and extending from said upper surface to said lower surface thereof, a pair of side edges disposed along opposite sides of said opening, said side edges extending from adjacent said at least one hollow core toward said facing surface of the block, said side edges having outermost flanges which extend generally in opposing relationship with respect to one another adjacent said facing surface of the block whereby said side edges and said flanges thereof function as a seat to retain a separate barrier member therebetween after the block has been placed

2. The concrete construction block of claim 1 in which said side edges are bevelled outwardly with respect to one another from adjacent said at least one hollow core and toward said outermost flanges.

3. The concrete construction block of claim 1 in which said outermost flanges in the block extend generally parallel with respect to one another from said upper surface to said lower surface thereof.

4. The concrete construction block of claim 3 in which said side edges are bevelled outwardly with respect to one another from adjacent said at least one hollow core and toward said outermost flanges.

5. The concrete construction block of claim 1 in which said side edges are bevelled inwardly with respect to one another from adjacent said at least one hollow core and toward said outermost flanges.

6. The concrete construction block of claim 5 in which said outermost flanges extend generally parallel with respect to one another from said upper surface to said lower surface of the block.

* * * * *